US008926378B2

(12) United States Patent
Tanimura

(10) Patent No.: US 8,926,378 B2
(45) Date of Patent: Jan. 6, 2015

(54) CONNECTOR HAVING A FIRST HOUSING WITH A PROJECTION WITH AN REINFORCEMENT ACCOMMODATED IN A CUT IN A SECOND HOUSING

(71) Applicant: Sumitomo Wiring Systems, Ltd., Yokkaichi, Mie (JP)

(72) Inventor: Shunsuke Tanimura, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 81 days.

(21) Appl. No.: 13/849,677

(22) Filed: Mar. 25, 2013

(65) Prior Publication Data

US 2013/0280964 A1 Oct. 24, 2013

(30) Foreign Application Priority Data

Apr. 18, 2012 (JP) ..... 2012-094599

(51) Int. Cl.
*H01R 13/502* (2006.01)
*H01R 13/629* (2006.01)
*H01R 13/514* (2006.01)

(52) U.S. Cl.
CPC ..... *H01R 13/514* (2013.01); *H01R 13/629* (2013.01)
USPC ..... 439/701

(58) Field of Classification Search
USPC ..... 439/701, 355, 345, 752
See application file for complete search history.

(56) References Cited

U.S. PATENT DOCUMENTS

| | | | | |
|---|---|---|---|---|
| 6,666,728 | B2 * | 12/2003 | Tachi et al. | 439/701 |
| 6,702,628 | B2 * | 3/2004 | Tanaka et al. | 439/752 |
| 7,063,577 | B2 * | 6/2006 | Fujita et al. | 439/701 |
| 7,201,609 | B2 | 4/2007 | Ishikawa | |
| 2007/0072492 | A1 * | 3/2007 | Kobayashi et al. | 439/701 |
| 2008/0242158 | A1 * | 10/2008 | Matsushita | 439/701 |
| 2012/0088413 | A1 * | 4/2012 | Kataoka et al. | 439/701 |

* cited by examiner

*Primary Examiner* — Chandrika Prasad
(74) *Attorney, Agent, or Firm* — Gerald E. Hespos; Michael J. Porco; Matthew T. Hespos

(57) ABSTRACT

A first housing (10) includes a first frame (11) with a frame main body (12) and a receptacle (13), a plurality of first sub-housings (17) individually accommodated in first accommodation spaces (14) of the first frame (11), a projection (21) projecting forward from the frame main body (12) and reinforcements (22) projecting from outer surfaces of the projection (21). A second housing (30) includes a second frame (31) with second accommodation spaces (32), second sub-housings (35) individually accommodated in the second accommodation spaces (32), a second partition wall (33) between adjacent second accommodation spaces (32), an accommodating recess (38) in the second partition wall (33) and configured to accommodate the projection (21). A cut portion (39) is formed in the second partition wall (33) and accommodates the reinforcements (22).

10 Claims, 8 Drawing Sheets

CONNECTOR HAVING A FIRST HOUSING WITH A PROJECTION WITH AN REINFORCEMENT ACCOMMODATED IN A CUT IN A SECOND HOUSING

BACKGROUND OF THE INVENTION

1. Field of the Invention

The invention relates to a connector.

2. Description of the Related Art

U.S. Pat. No. 7,201,609 discloses a divided-type connector with first and second housings that are connectable to each other. The first housing includes a first frame, a plurality of first sub-housings, and a plurality of male first terminal fittings mounted in the respective first sub-housings. The first frame has a frame main body formed with first accommodation spaces for accommodating the first sub-housings and a receptacle extending forward from the outer periphery of the frame main body. The first sub-housings are accommodated respectively into each first accommodation space. Tabs of the first terminal fittings project forward from each first sub-housing and are surrounded collectively by the receptacle. The second housing includes a second frame, a plurality of second sub-housings and female second terminal fittings mounted in the respective second sub-housings. The second frame has second accommodation spaces for accommodating the second sub-housings.

A forcible connection preventing means projects forward from the front surface of the main body of the first frame for preventing the first and second housings from being connected in oblique postures. On the other hand, the second frame has a partition wall between adjacent second accommodation spaces, and an accommodating recess is formed in the partition for accommodating the projection when the two housings are connected.

Miniaturizing the above-described connector reduces the sizes of the terminal fittings and also requires the projection to be thinned. A thinned projection is less strong. As a countermeasure, thought has been given to form a reinforcement extending in a connecting direction of the two housings on an outer surface of the projection. However, a reinforcement that projects from the outer surface of the projection requires a larger volume for the accommodating recess, thereby affecting miniaturization efforts.

The invention was completed in view of the above situation and an object thereof is to allow miniaturization of a connector.

SUMMARY OF THE INVENTION

The invention relates to a connector with first and second housings that are connectable to one another. The first housing includes a frame with a frame main body that has first accommodation spaces and a receptacle that extends forward from the frame main body. First sub-housings are accommodated individually in the respective first accommodation spaces and first terminal fittings are mounted in the sub-housings. At least one projection projects forward from the front surface of the frame main body and at least one reinforcement projects from an outer surface of the projection. The second housing has a second frame with second accommodation spaces. Second sub-housings are accommodated individually in the respective second accommodation spaces and second terminal fittings are mounted in the second sub-housings. An accommodating recess is formed in the second frame and is configured to accommodate the projection when the second housing is fit into the receptacle At least one cut is formed in the second frame between the accommodating recess and the second accommodation space. The cut is configured to accommodate the reinforcement when the projection is accommodated into the accommodating recess. Thus, the volume of the reinforcement can be omitted from the volume of the accommodating recess. Therefore, the reinforcement does not require a larger accommodating recess and the entire connector can be miniaturized while ensuring a strong projection.

At least one partition wall is formed in the second frame and defines a partition between adjacent second accommodation spaces. The accommodating recess is formed in the partition wall. The cut also is in the partition wall to provide communication between the accommodating recess and an outer surface of the partition wall.

The reinforcement may be formed only near a base end of the projection. Thus, a formation range of the cut also can be small and the cut will not significantly reduce the strength of the partition wall.

A formation area of the reinforcement in a direction intersecting the projecting direction of the projection may be only a part of the projection. Thus, the cut is small and will not significantly reduce the strength of the partition wall.

A projecting end of the projection may be located behind a projecting end of the receptacle with respect to a connecting direction of the first and second housings.

Two reinforcements may be provided and the reinforcements may be point-symmetrical with respect to an axis parallel to a projecting direction of the projection.

The reinforcement may be substantially L shaped.

The accommodating recess may be a dead-end recess.

A hollow interior of the accommodating recess may be filled up by the projection with almost no clearance when the first and second housings are connected These and other features and advantages of the invention will become more apparent upon reading of the following detailed description of preferred embodiments and accompanying drawings.

DETAILED DESCRIPTION OF THE PREFERRED EMBODIMENTS

A connector in accordance with the invention comprises a first housing 10 and a second housing 30 that are to be connected to and separated from each other, as shown in FIGS. 1 to 8. In the following description, forward and backward directions and connecting and separating directions CSD of the two housings 10, 30 are used synonymously and define parallel directions.

Figure 1:
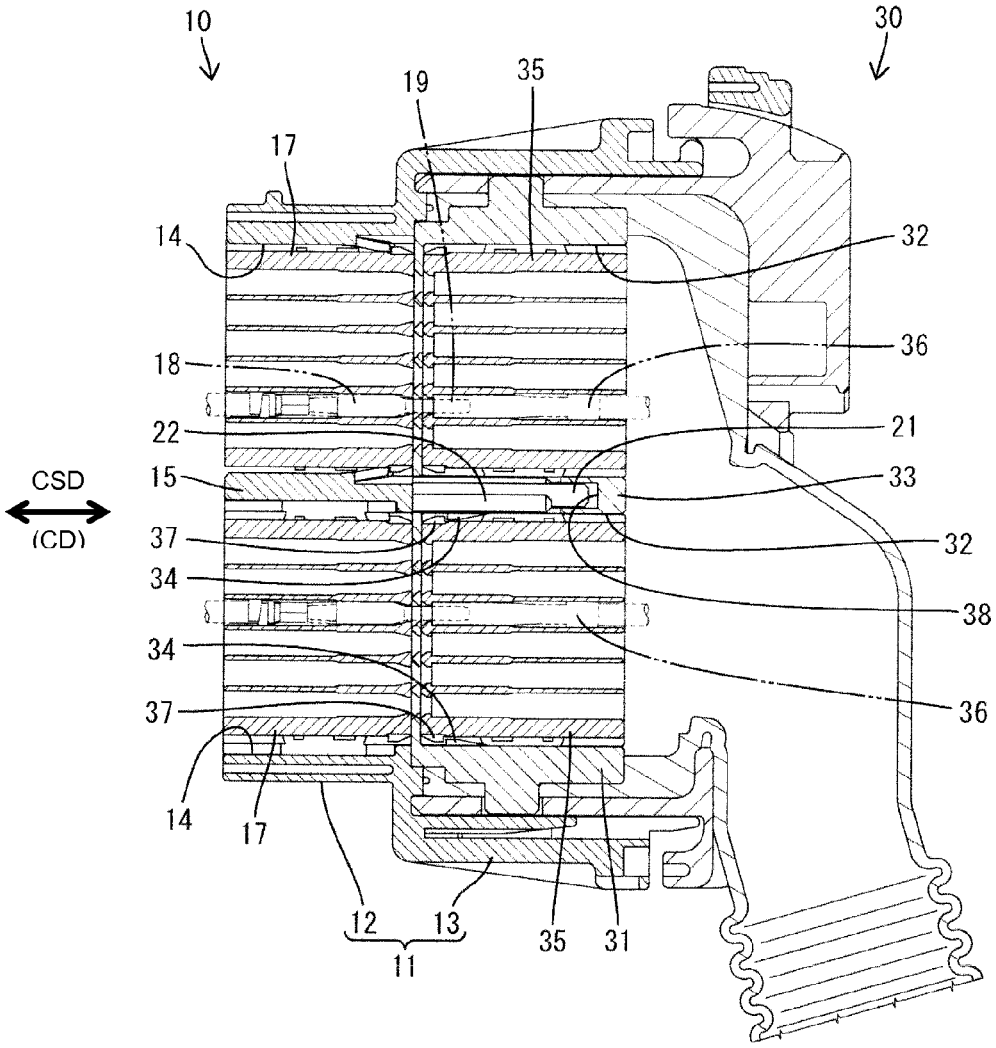
FIG. 1 is a section showing a state where a first housing and a second housing of one embodiment are connected.
Figure 2:
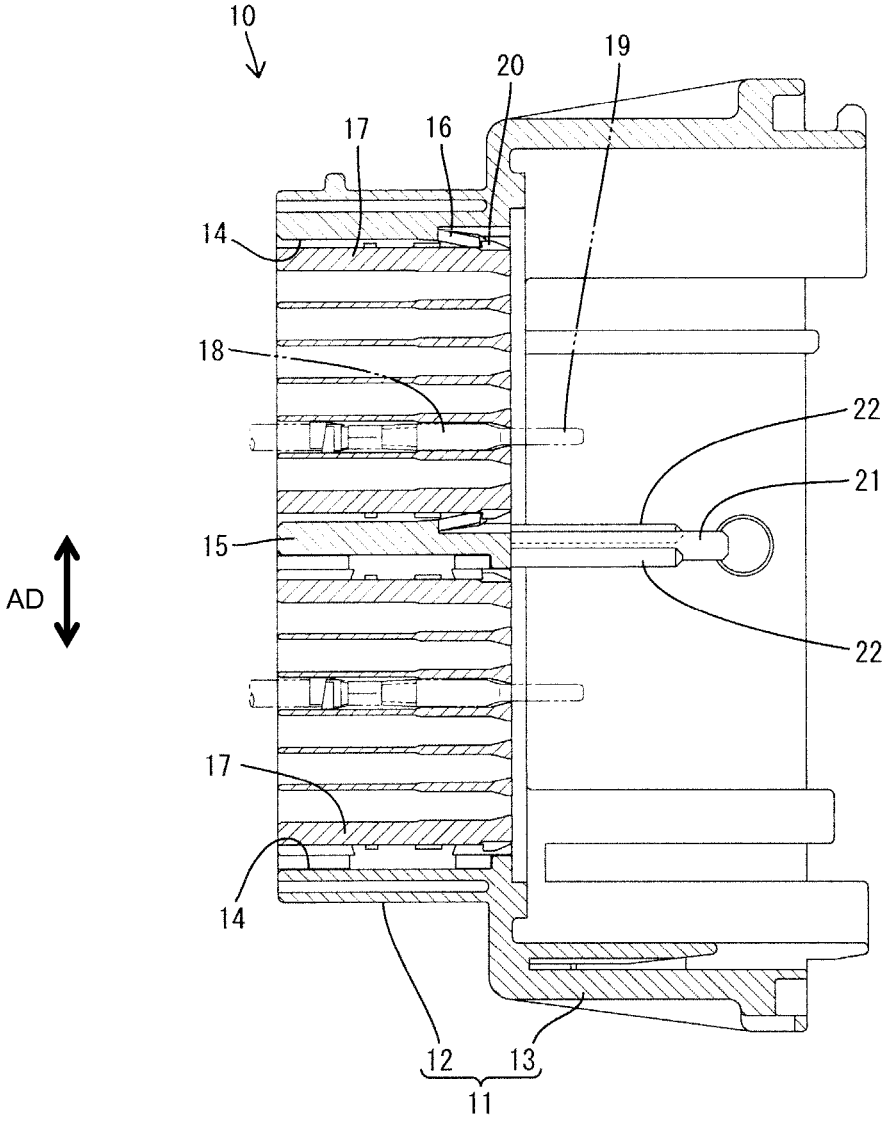
FIG. 2 is a section of the first housing.
Figure 4:
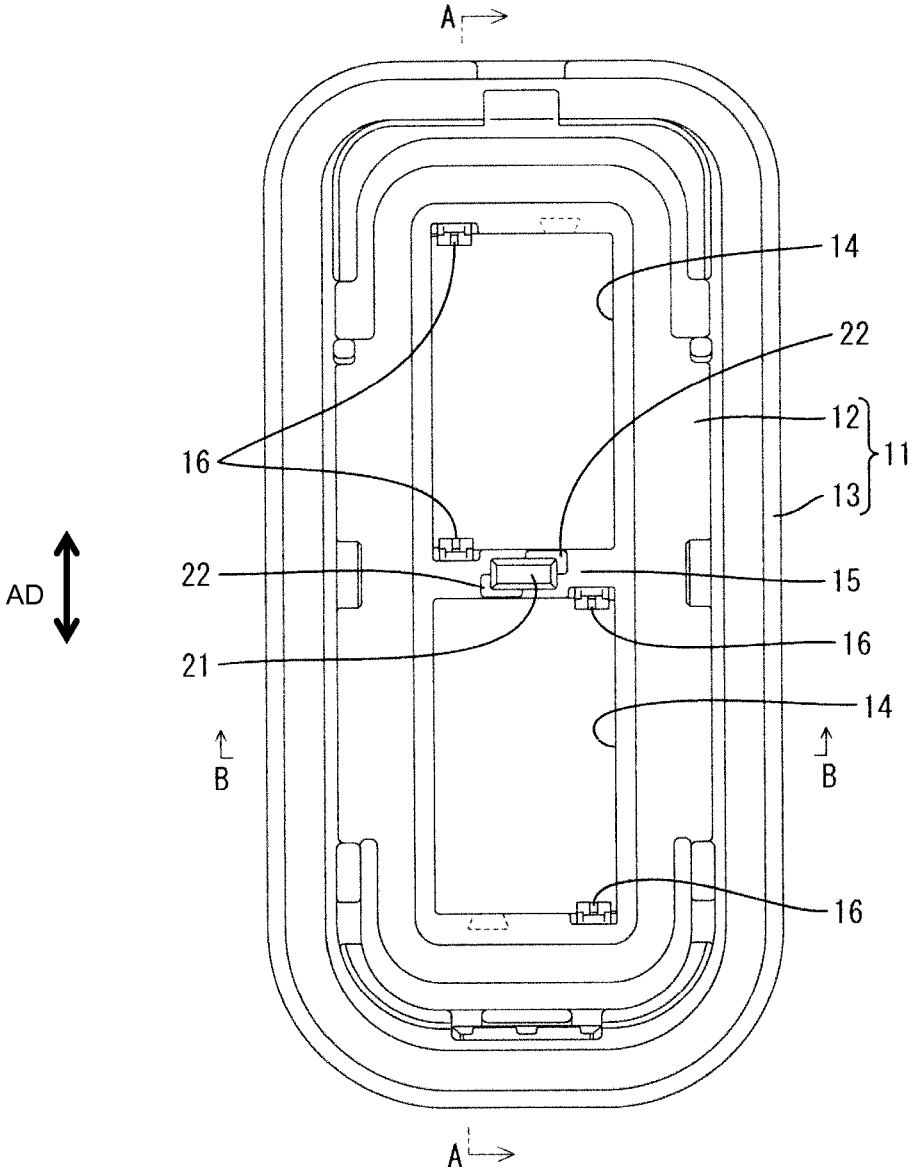
FIG. 4 is a front view of a first frame.
Figure 5:
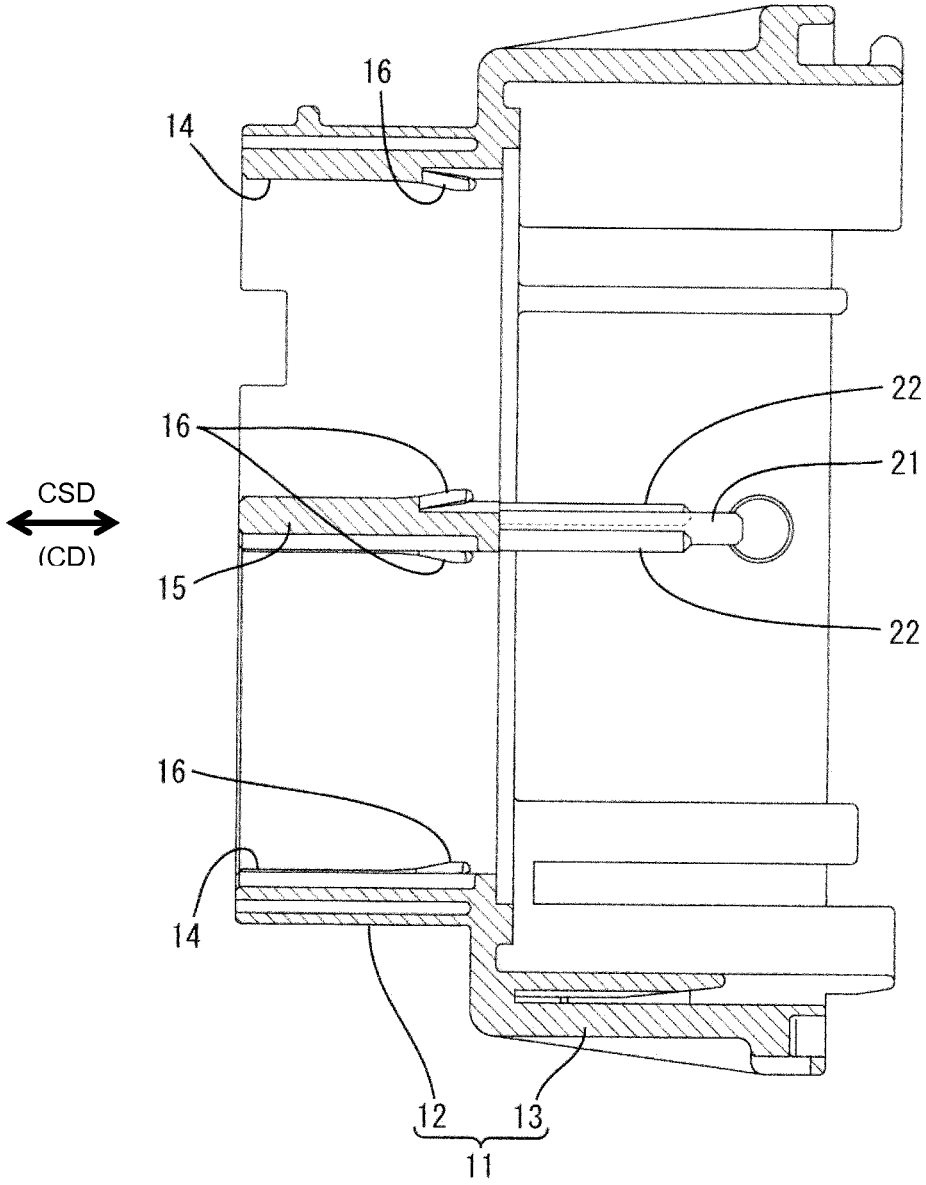
FIG. 5 is a section along A-A of FIG. 4.

As shown in FIG. 2, the first housing 10 includes a first frame 11 made e.g. of synthetic resin, two first sub-housings 17 made e.g. of synthetic resin and a plurality of male first terminal fittings 18. As shown in FIGS. 4 and 5, the first frame 11 is vertically long and is formed unitarily with a frame main body 12 and a rectangular tubular receptacle 13 that extends forward from the outer periphery of the frame main body 12. Two first accommodation spaces 14 penetrate the frame main body 12 in forward and backward directions and are arranged substantially side by side in a vertical arrangement direction AD that is substantially orthogonal to the connecting direction CD of the two housings 10, 30. The first accommodation spaces 14 are partitioned by a substantially horizontal first partition wall 15. First locking lances 16 are cantilevered forward from upper and lower inner surfaces of each first accommodation space 14.

The first terminal fittings 18 are mounted in each first sub-housing 17, and tabs 19 at the leading ends of the first terminal fittings 18 project forward from the first sub-housing 17, as shown in FIG. 2. First locking protrusions 20 are formed on upper and lower outer surfaces of each first sub-housing 17. The first sub-housings 17 are fit into the first accommodation spaces 14 from behind the frame main body 12 and the first locking lances 16 engage the first locking protrusions 20 to retain the first sub-housings 17. The receptacle 13 collectively surrounds the tabs 19 when the first sub-housing 17 is mounted in the first frame 11, thereby protecting the tabs 19 from the interference of external matter.

Figure 3:
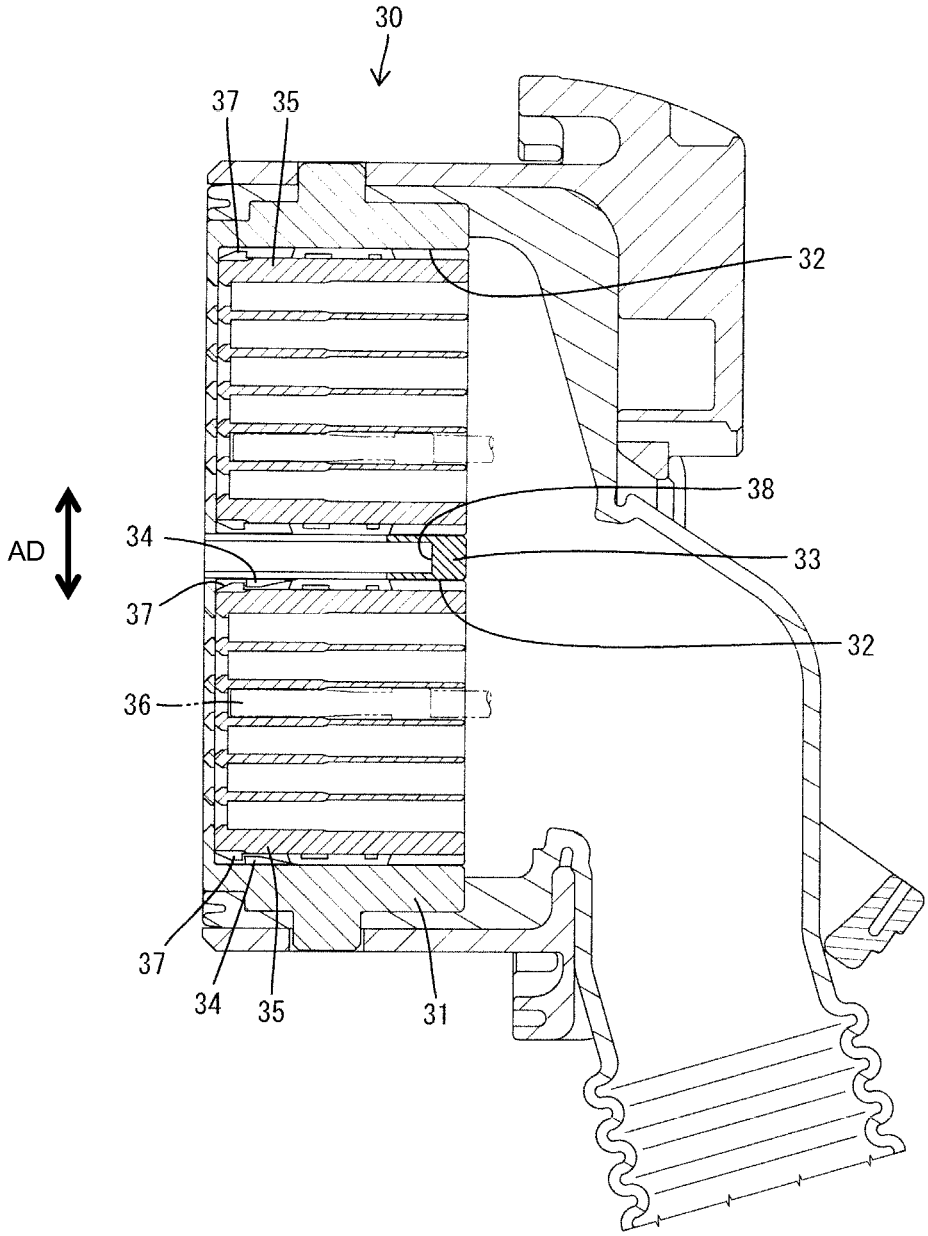
FIG. 3 is a section of the second housing.
Figure 7:
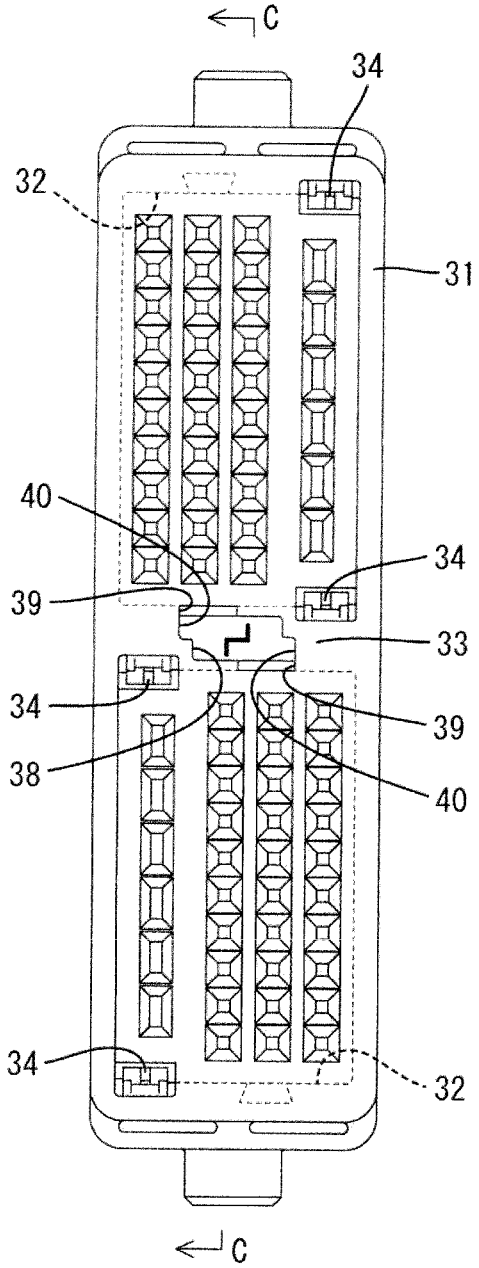
FIG. 7 is a front view of a second frame.
Figure 8:
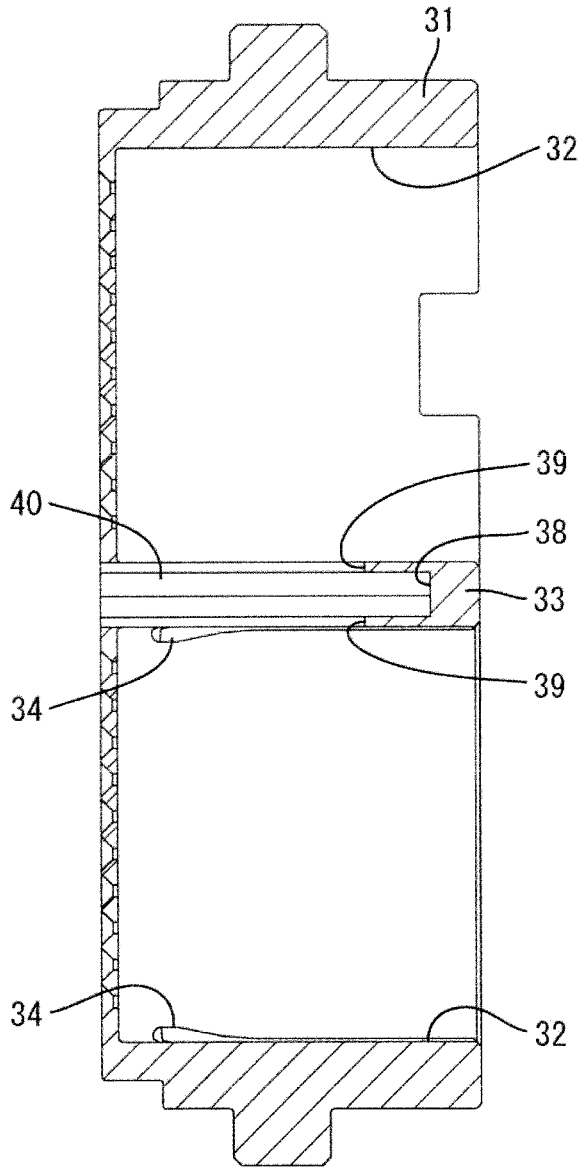
FIG. 8 is a section along C-C of FIG. 7.

As shown in FIG. 3, the second housing 30 includes a second frame 31 made e.g. of synthetic resin, two second sub-housings 35 made e.g. of synthetic resin and a plurality of female second terminal fittings 36. As shown in FIGS. 7 and 8, the second frame 31 is vertically long. Two second accommodation spaces 32 penetrate the second frame in forward and backward directions and are arranged substantially side by side in the vertical direction, which is orthogonal to the connecting direction CD of the two housings 10, 30. The two second accommodation spaces 32 are partitioned by a substantially horizontal second partition wall 33. Second locking lances 34 are cantilevered forward from upper and lower inner surfaces of each second accommodation space 32.

As shown in FIG. 3, second terminal fittings 36 are mounted in each second sub-housing 35. Second locking protrusions 37 are formed on upper and lower outer surfaces of each second sub-housing 35. The second sub-housings 35 are fit into the second accommodation spaces 32 from behind the second frame 31. The second locking lances 34 engage the second locking protrusions 37 to retain the second sub-housing 35.

Figure 6:
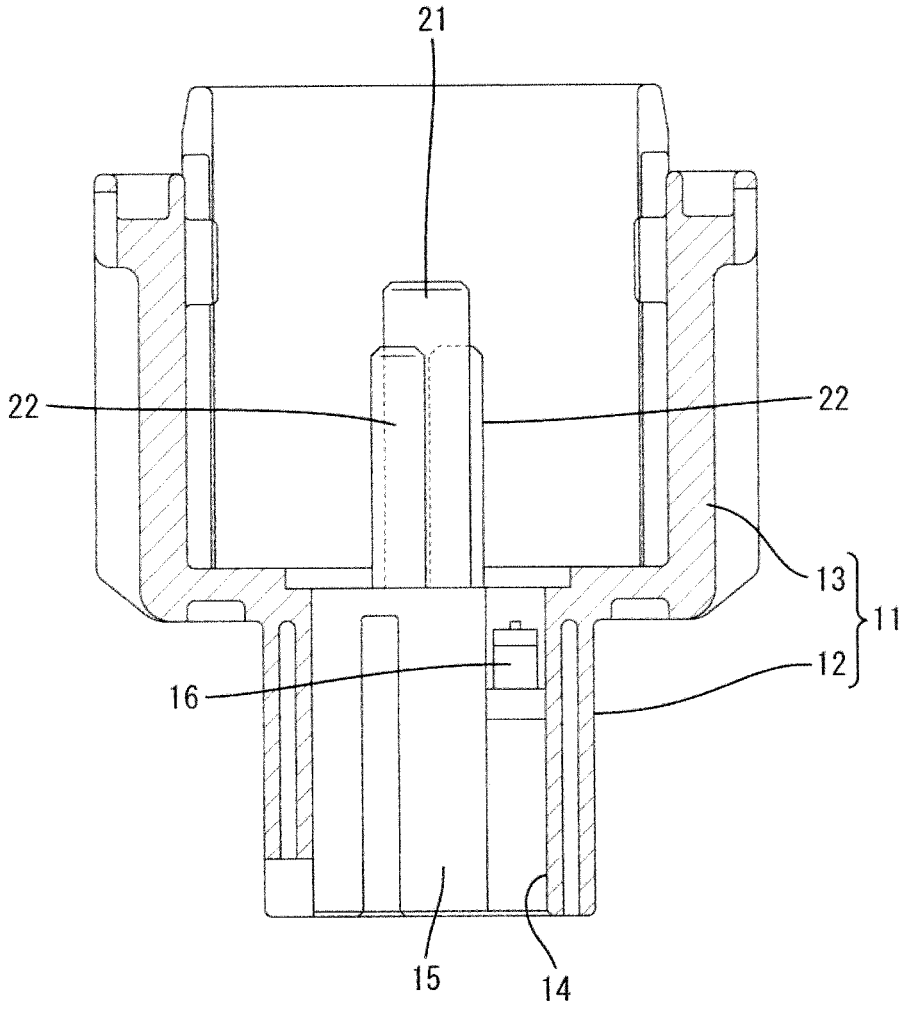
FIG. 6 is a section along B-B of FIG. 4.

The connector has a forcible connection preventing means for preventing the two housings 10, 30 from being connected in oblique postures. As shown in FIGS. 4 to 6, the forcible connection preventing means comprises a projection 21 that projects forward along the connecting direction CD from the front surface of the first partition wall 15 of the first frame 11. A projecting direction of the projection 21 is substantially parallel to the connecting and separating directions CSD of the two housings 10, 30. Further, the projection 21 is in a substantially central part of the first partition wall 15 in a width direction, which is orthogonal to both the arrangement direction AD of the first accommodation spaces 14 (vertical direction) and the connecting direction CD of the two housings 10, 30 (forward and backward directions). Thus, the projection 21 specifically is at a position not corresponding to the first locking lances 16. The front projecting end of the projection 21 is behind the front end of the receptacle 13. As shown in FIG. 4, the projection 21 has a substantially rectangular shape that is long in the width direction (direction parallel to the first partition wall 15) when viewed from the front.

The connector of this embodiment is miniaturized. The first terminal fittings 18 and the projection 21 normally would be thinned to achieve miniaturization. However, a thinned projection 21 might be too weak. As a countermeasure, two reinforcements 22 are formed on outer surfaces of the projections 21 and extend substantially along the connecting direction CD of the two housings 10, 30 as shown in FIGS. 4 to 6. The reinforcements 22 extend in the connecting direction CD along only a part of the projection 21 at a base end of the projection 21, and the reinforcements 22 are not formed at a front end part of the projection 21.

As shown in FIG. 4, the two reinforcements 22 are point-symmetrical with respect to an axis parallel to the forward and backward projecting direction of the projection 21. One reinforcement 22 extend in an upper area of the right surface of the projection 21 and a right area of the upper surface of the projection 21 to define a substantially L shape. The other reinforcement 22 extends in a lower area of the left surface of the projection 21 and a left area of the lower surface of the projection 21 to define a substantially L shape. That is, a formation area of the reinforcements 22 in the lateral direction and the vertical or thickness direction is only a part of the projection 21.

As shown in FIG. 8, an accommodating recess 38 is formed in the second partition wall 33 of the second frame 31 for accommodating the projection 21 when the two housings 10, 30 are connected. The front end of the accommodating recess 38 is open on the front end surface of the second partition wall 33, whereas the rear end thereof is not open on the rear end surface of the second partition wall 33. Thus, the accommodating recess 38 is a dead-end recess. As shown in FIG. 7, the accommodating recess 38 is formed in a central part of the second partition wall 33 in the lateral direction and at a position corresponding to the projection 21.

Further, as shown in FIGS. 7 and 8, the second partition wall 33 is formed with two cut portions 39 communicating between the interior of the accommodating recess 38 and the outer upper surface and lower surface of the second partition wall 33. The reinforcements 22 are to be accommodated into the respective cut portions 39 when the two housings 10, 30 are connected. The cut portions 39 are substantially point-symmetrical with respect to an axis parallel to the forward and backward connecting direction CD. The upper cut portion 39 is in a left half area of the accommodating recess 38 to correspond to the one reinforcement 22 and the lower cut portion 39 is formed in a right area of the accommodating recess 38 to correspond to the other reinforcement 22.

Further, as shown in FIG. 7, the second partition wall 33 is formed with two escaping grooves 40 for accommodating parts of the reinforcements 22 formed on the left and right surfaces of the projection 21, and the escaping grooves 40 communicate with the accommodating recess 38. The left escaping groove 40 is formed in an upper area) of the accommodating recess 38 and the right escaping groove 40 is formed in a lower area of the accommodating recess 38.

In a state where the two housings 10, 30 are connected, the projection 21 is fit in the accommodating recess 38 and the reinforcements 22 are fit into the cut portions 39 and the escaping grooves 40. In this way, the hollow interior of the accommodating recess 38 is filled up by the projection 21 with almost no clearance, and specifically the hollow interiors of the cut portions 39 and the escaping grooves 40 are filled up by the reinforcements 22 with almost no clearance. Thus, the projection 21 and the reinforcements 22 form a part of the second partition wall 33. Further, the upper surface of the one reinforcement 22 and the lower surface of the other reinforcement 22 are respectively continuous and flush with the respective upper and lower surfaces of the second partition wall 33.

As described above, in the connector of this embodiment, the reinforcements 22 are accommodated into the cut portions 39 of the second partition wall 33 when the two housings 10, 30 are connected and the projection 21 is accommodated into the accommodating recess 38. Thus, the volume of the reinforcements 22 can be omitted from a volume to be ensured as the accommodating recess 38. Therefore, even if the reinforcements 22 project on the outer surfaces of the projection 21, an increase in the volume of the accommodating recess 38 can be suppressed and, consequently, the entire connector can be miniaturized.

Further, the formation area of the reinforcements 22 in the projecting direction of the projection 21 is only a partial range at the base end of the projection 21. Thus, a formation area of the cut portions 39 in the projecting direction of the projection 21 (depth direction of the accommodating recess 38) can be smaller. This can suppress a reduction in the strength of the second partition wall 33 due to the formation of the cut portions 39.

Furthermore, the formation area of the reinforcements 22 in the direction intersecting the connecting direction CD is only part of the projection 21. Thus, a formation area of the cut portion(s) 39 in the direction intersecting with the projecting direction of the projection 21 (depth direction of the accommodating recess 38) can be smaller. This can suppress a reduction in the strength of the second partition wall 33 due to the formation of the cut portions 39.

The invention is not limited to the above described embodiment. For example, the following embodiments also are included in the scope of the invention as defined in the claims.

The reinforcements extend along only part of the projection in the above embodiment. However, the formation area may extend over substantially the entire length of the projection.

Although the formation area of the reinforcements in the direction intersecting with the projecting direction of the projection is only the part of the projection in the above embodiment, it may extend over the substantially entire projection.

Although two reinforcements are formed on the projection in the above embodiment, more or fewer reinforcements may be provided.

Although the pair of reinforcements are point-symmetrical in the above embodiment, they may be asymmetrical.

Although one projection is provided in the above embodiment, a plurality of projections may be provided.

Although two first accommodation spaces and two second accommodation spaces are provided in the above embodiment, one, three or more first accommodation spaces and three or more second accommodation spaces may be provided.

What is claimed is:

1. A connector, comprising:

a first housing including a first frame with a frame main body formed with first accommodation spaces and a receptacle extending forward from the frame main body, at least one projection projecting forward from a front surface of the frame main body, at least one reinforcement projecting from an outer surface of the projection;

first sub-housings mounted respectively in the first accommodation spaces;

first terminal fittings mounted in the first sub-housings;

a second housing connectable to the first housing, the second housing including a second frame formed with second accommodation spaces;

second sub-housings accommodated respectively in the second accommodation spaces;

second terminal fittings to be mounted in the second sub-housings;

an accommodating recess formed in the second frame and configured to accommodate the projection when the second housing is fit into the receptacle; and at least one cut portion formed in the second frame and providing communication between the accommodating recess and the second accommodation space, the cut portion being configured to accommodate the reinforcement when the projection is accommodated into the accommodating recess.

2. The connector of claim 1, wherein at least one partition wall is formed in the second frame between the second accommodation spaces.

3. The connector of claim 2, wherein the accommodating recess is formed in the partition wall and wherein the at least one cut portion is formed in the partition wall and communicates between the accommodating recess and an outer surface of the partition wall.

4. The connector of claim 1, the reinforcement extends along only a part of the projection adjacent a base end of the projection.

5. The connector of claim 1, wherein a formation area of the reinforcement in a direction intersecting with a projection direction of the projection is only a part of the projection.

6. The connector of claim 1, wherein a projecting end of the projection is behind a projecting end of the receptacle with respect to a connecting direction of the first and second housings.

7. The connector of claim 1, wherein two of the reinforcements are provided the projection and are substantially are point-symmetrical with respect to an axis parallel to a projecting direction of the projection.

8. The connector of claim 1, wherein the reinforcement is substantially L shaped.

9. The connector of claim 1, wherein the accommodating recess is a dead-end recess.

10. The connector of claim 1, wherein in a state where the first and second housings are connected, a hollow interior of the accommodating recess is filled substantially by the projection with almost no clearance.

* * * * *